US006961980B1

(12) United States Patent
Candotti

(10) Patent No.: US 6,961,980 B1
(45) Date of Patent: Nov. 8, 2005

(54) PRESS-STUD WITH LATERAL LOCKING

(75) Inventor: Riccardo Candotti, Padua (IT)

(73) Assignee: Cobra Trade S.A., Luxembourg (LU)

( * ) Notice: Subject to any disclaimer, the term of this patent is extended or adjusted under 35 U.S.C. 154(b) by 0 days.

(21) Appl. No.: 09/498,726

(22) Filed: Feb. 7, 2000

(30) Foreign Application Priority Data

Feb. 12, 1999 (IT) ..... PD99A0027

(51) Int. Cl.[7] ..... A44B 17/00
(52) U.S. Cl. ..... 24/667; 24/701
(58) Field of Search ..... 24/666–668, 701, 24/651, 104, 106, 108

(56) References Cited

U.S. PATENT DOCUMENTS

| | | | | |
|---|---|---|---|---|
| 142,686 | A | * | 9/1873 | Durand |
| 244,171 | A | * | 7/1881 | Beach |
| 715,644 | A | * | 12/1902 | Dinkelspiel |
| 1,182,069 | A | * | 5/1916 | Backmyer |
| 1,205,053 | A | * | 11/1916 | Steiner |
| 1,216,263 | A | * | 2/1917 | Backmyer |
| 1,265,769 | A | * | 5/1918 | Galt, Jr. |
| 1,330,426 | A | * | 2/1920 | Bishop |
| 1,348,011 | A | * | 7/1920 | Lammers |
| 2,071,575 | A | * | 2/1937 | Reiter |
| 2,193,802 | A | * | 3/1940 | Chambless et al. |
| 2,387,575 | A | * | 10/1945 | Gobin Dit Daude |
| 2,895,199 | A | | 7/1959 | Jones |
| 4,271,999 | A | * | 6/1981 | Stravitz |
| 4,699,076 | A | * | 10/1987 | Curtis et al. |
| 4,785,508 | A | | 11/1988 | Tadashi |

FOREIGN PATENT DOCUMENTS

| | | | |
|---|---|---|---|
| DE | 349430 | * | 3/1922 |
| EP | 0 487 162 | | 5/1992 |
| GB | 24034 | * | of 1914 |

* cited by examiner

*Primary Examiner*—James R. Brittain
(74) *Attorney, Agent, or Firm*—Daniel O'Byrne

(57) ABSTRACT

A press-stud with lateral locking, having a male component and a female component which must be associable with each other, the female component has a seat which is suitable to accommodate, by insertion, the head of a mushroom-shaped element which protrudes from the male component; the seat can be accessed by the head through an opening which has a first larger part which allows insertion of the head and a second smaller part whose dimensions are intermediate between the dimensions of the head and the dimensions of the stem, the seat accommodating elastic contrast elements which allow the head to move over them during insertion and extraction, with a movement of the head toward the first part of the opening that is larger than the second smaller part, and viceversa.

10 Claims, 5 Drawing Sheets

PRESS-STUD WITH LATERAL LOCKING

BACKGROUND OF THE INVENTION

The present invention relates to a press-stud with lateral locking.

It is known that metallic press-studs are increasingly appreciated and widely used in the field of clothing, and particularly in items meant for young, casual-dressing customers, for leather goods and for many other items.

Press-studs of this type comprise a female component and a male component which are respectively associated with a first part and a second part which belong to a same item and must be rendered associable with each other.

The female component is normally constituted by a tubular stem, whose inside constitutes the seat for the male component, which is obtained by drawing a metal lamina and is provided with a disk-like head whose rim is folded back.

A spring is arranged between two diametrically opposite slots of the stem and the folded-back rim, and acts as an elastic contrast for the male element, which is constituted by a mushroom-shaped element which rises, in this case, from a disk-like base.

The mushroom-shaped element is of course suitable for insertion in the female component and is furthermore provided with a diametrical recess which accommodates the two parts of the spring that protrude from the slots inside the seat.

It is very important to note that press-studs of this type are unable to provide significant resistance when they are affected by a certain traction applied at right angles to their engagement axis, because the forces are in any case discharged entirely onto the elastic means.

Actually, in the items to which said press-studs are applied, for example items of clothing or leather goods, the press-studs should "hold" especially at right angles to their engagement axis, since the movements performed by the user would tend to move apart the two parts with which the male component and the female component are respectively associated, producing tractions in this direction.

To give an example, this is what normally happens to the press-studs of a shirt, of a jacket or of a pair of pants due to the movement of the user.

It should also be noted that in closing said press-studs the user must very often keep one finger in the region below the component on which the engagement pressure is applied.

This precaution is practically indispensable if the press-studs are applied to an item of clothing, since the pressure that must be applied to close them is sometimes considerable, especially at particularly delicate parts of the human body, as in the case of shirts or at the waist of a pair of pants.

In other words, the user must take care to protect himself when he applies the pressure for closing each press-stud.

However, other items may also require one to behave in the same manner and keep one finger in the region below the part with which the female component is associated in order to be able to apply a pressure which is suitable to engage therein the male component.

SUMMARY OF THE INVENTION

The aim of the present invention is to provide a press-stud which, with respect to conventional press-studs, is capable of ensuring resistance especially at right angles to the engagement axis, which is the direction in which the highest stresses occur.

Within this aim, an important object of the present invention is to provide a press-stud which requires, both during closure and during opening, considerably less force than conventional press-studs without however allowing any possibility of accidental opening.

Furthermore, it is certainly desirable for the press-stud to be provided by means of the present invention not to force the user, in order to avoid getting hurt, to resort to particular precautions in order to protect the part of his body that lies below each press-stud.

Another object of the present invention is to provide a press-stud which can be manufactured in practice by resorting to per se known equipment and machines.

Another object of the present invention is to provide a press-stud which can be applied to clothing cheaply and automatically, like most commercially available press-studs.

This aim, these objects and others which will become apparent hereinafter are achieved by a press-stud with lateral locking, which comprises a male component and a female component which must be associable with each other, said female component having a seat which is suitable to accommodate, by insertion, the head of a mushroom-shaped element which protrudes from said male component, said press-stud being characterized in that said seat can be accessed by said head by virtue of an opening which has a first larger part and a second smaller part whose dimensions are intermediate between the dimensions of the head and the dimensions of the stem, said seat accommodating elastic contrast elements which allow said head to move over them during insertion and extraction with a movement of said head toward the first part of said opening that is larger than the smaller second part, and viceversa.

BRIEF DESCRIPTION OF THE DRAWINGS

Further characteristics and advantages of the present invention will become apparent from the following detailed description of some preferred embodiments, illustrated only by way of non-limitative example in the accompanying drawings, wherein.

DESCRIPTION OF THE PREFERRED EMBODIMENTS

Figure 1:
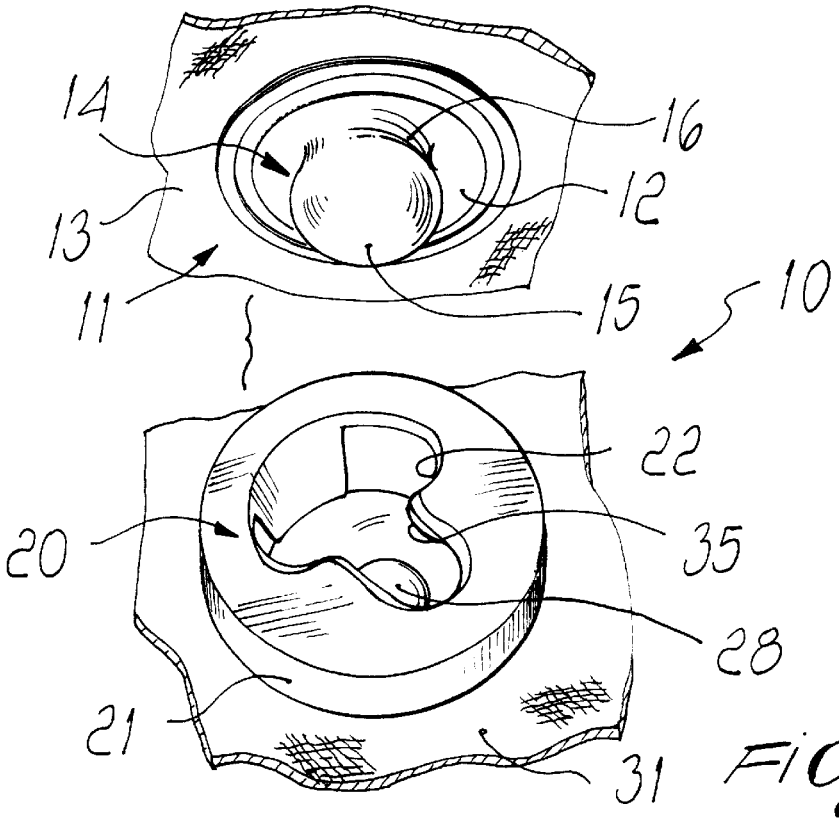
FIG. 1 is a perspective view of a press-stud with lateral locking, according to the present invention, in the open position.
Figure 2:
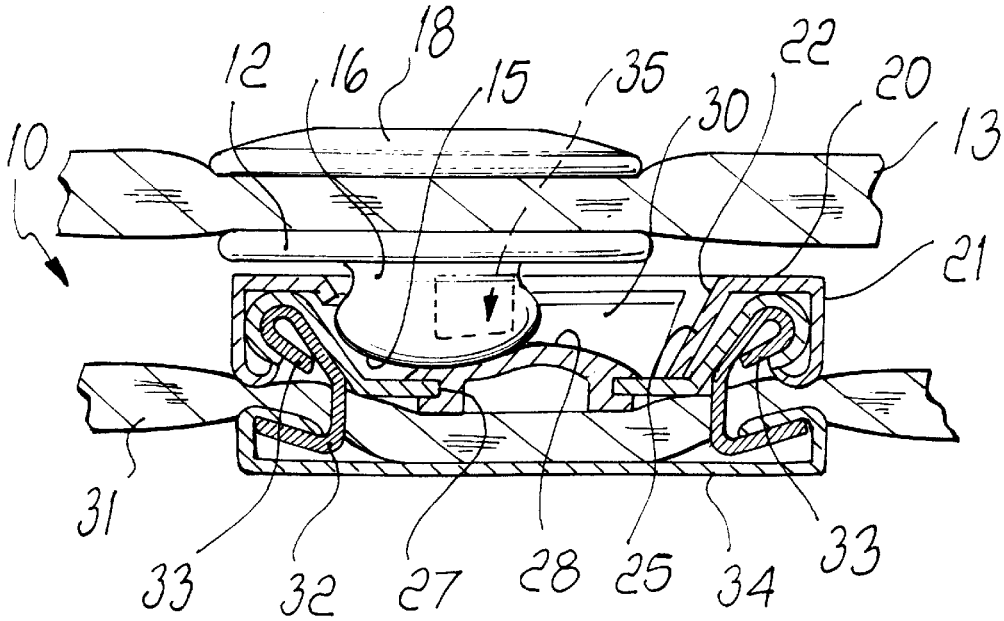
FIG. 2 is a sectional view, taken along a transverse plane, of the press-stud of FIG. 1 in the closed position.
Figure 3:
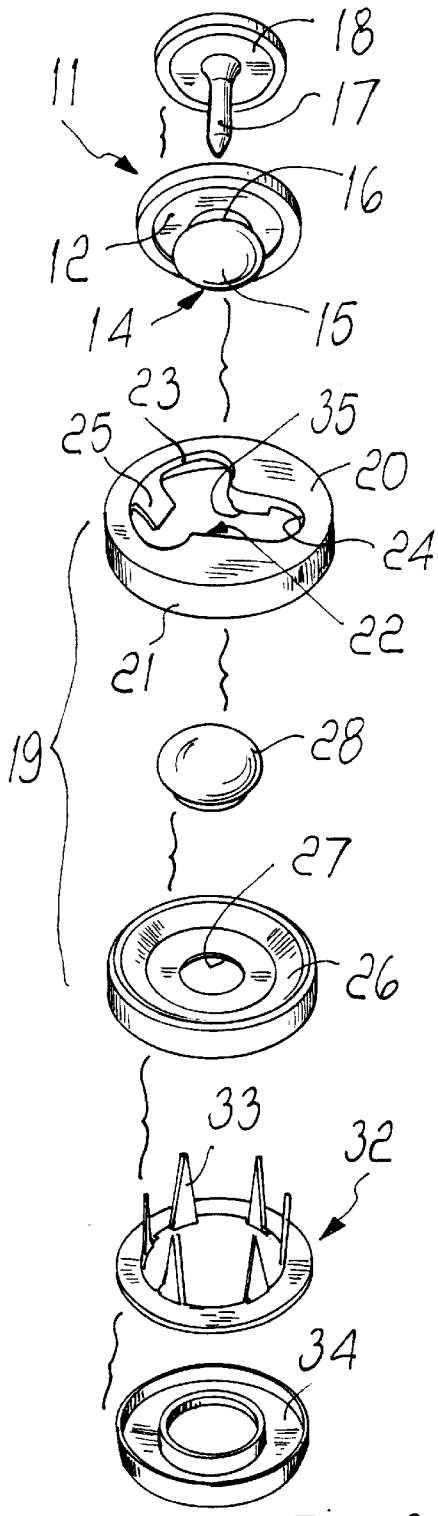
FIG. 3 is an exploded view of the press-stud of FIGS. 1 and 2.
Figure 7:
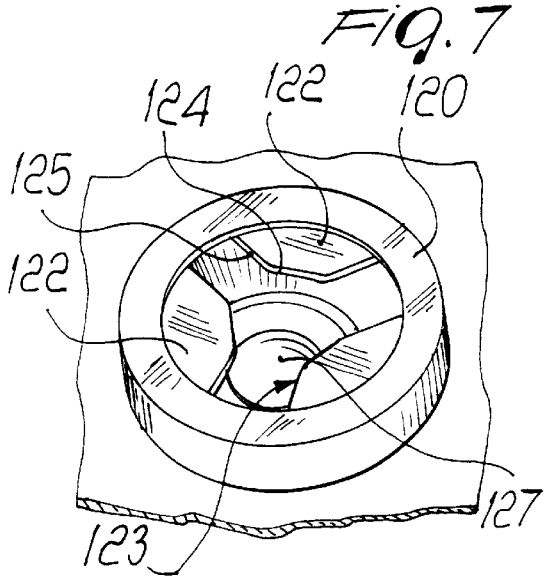
FIG. 7 is a perspective view of a detail of the press-stud of FIG. 6.
Figure 6:
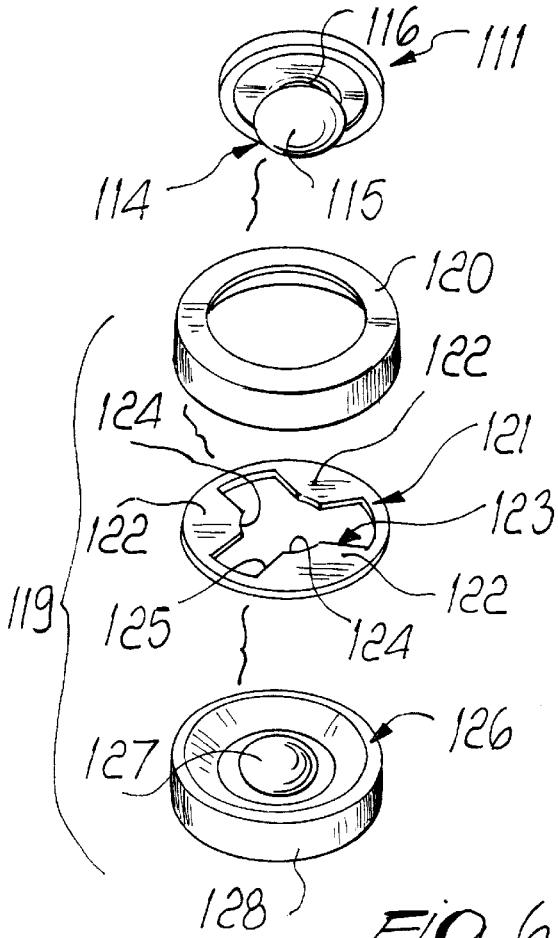
FIG. 6 is an exploded view of a third embodiment of a press-stud with lateral locking

With reference to the above cited FIGS. 1 to 3, a press-stud with lateral locking, in a first constructive configuration, is generally designated by the reference numeral 10 and comprises a male component 11, which is constituted by a disk-like base 12 which is associated, as will become apparent hereinafter, with a first part 13, in this purely exemplifying case, of an item of clothing.

A mushroom-shaped element 14 protrudes monolithically from the disk-like base 12 and has a rounded head 15 which is larger than the stem 16.

The male component 11 is fixed to the first part 13 of the item of clothing by means of a nail 17 which is associated with a base 18 which passes through the fabric of the first part 13 and enters, undergoing deformation, the mushroom-shaped element 14 so as to constitute in practice a monolithic body.

In this manner, the fabric of said first part 13 is interposed between said base 18 and the disk-like base 12 of the male component 11.

Said press-stud 10 furthermore comprises a female component, generally designated by the reference numeral 19, which comprises a disk-like dome 20 which is perimetrically provided with a rim 21 and on which a shaped opening 22 is formed by blanking.

In this case, said opening 22 has a first wider part 23, which is larger than the head 15 of the mushroom-shaped element 14, and a second part 24, which with respect to the first part is substantially elongated and arranged laterally thereto and has dimensions which are intermediate between those of the head 15 and of the stem 16 of the male component 11.

In particular, each one of said first and second parts 23 and 24 of the opening 22 forms, with its rim, a substantially oval shape; said oval shapes are arranged at right angles to each other.

The material removed by blanking on the dome 20 in order to obtain the opening 22 produces a chute 25 which extends monolithically from a central portion of the rim of the first part 23 of said opening 22 with a substantially flat inclined portion which will be described in greater detail hereinafter.

The material removed by blanking in order to obtain the opening 22 also forms two wings 35, each of which protrudes from an opposite portion that connects the first and second parts 23 and 24 of the opening 22.

Said disk-like dome 20 is associated, in an upward region, with an annular base 26 whose central hole 27 is conveniently smaller than the opening 22.

In particular, said annular base 26 arranges itself inside the rim 21 of the dome 20, so that by folding back the end of said rim 21 the parts are fixed to each other.

Correspondingly, a dome-shaped element 28 engages in the central hole 27 of the annular base 26; said dome-shaped element is made of a plastic material which ensures elasticity characteristics.

The assembly of the dome-shaped element 28 in the hole 27 of the annular base 26 and of said annular base with the dome 20 forms, as a whole, an internal seat 30 which can be accessed by the head 15 from the first part 23 of the opening 22.

In particular, the dome-shaped element 28 delimits, with its rounded dimensions, the bottom of said internal seat 30, as described more clearly hereinafter.

It is thus evident that said chute 25 constitutes a guide for facilitating the access of the head 15 through the first part 23 of the opening 22 to the internal seat 30 arranged below the dome 20.

In an equivalent manner, the two wings 35 act as guides for the sliding of the stem 16 along the second part 24 of the opening 22, avoiding any scraping thereof due to imperfections in the blanking of the material performed in order to obtain the opening 22.

The two wings 35 are in fact located exactly at the region that connects the first wider part 23 and the second part 24 of the opening 22.

Said female component 19 is associated with a second part 31 of the same item of clothing by means of a claw 32 known per se which has corresponding dimensions and whose points 33, obtained by blanking and bending, after passing through the fabric of said second part 31, engage at the folded-back rim of the annular base 26, thus deforming so as to ensure mutual fixing.

In this case, said claw 32 for assembling the female component 19 to the second part 31 of the item of clothing is concealed from view by the fabric that can be overlapped thereon or is left exposed or is trimmed with an annular covering or by a simple dome or cap 34 which can be customized with decorative markings.

Closing the press-stud 10 is very easy, even with just one hand, and requires no particular pressure.

It is in fact sufficient to move the mushroom-shaped element 14 of the male component 11 toward the female component 19 so as to place it at the first part 23 of the opening 22.

After doing this, a slight force is applied so that the head 15, by following the guiding action of the chute 25, can be inserted in the internal seat 30 through the first part 23 of the opening 22.

At this point it is sufficient to guide the head 15 in its translatory motion, assisted by the guiding action ensured by the two wings 35, so that it moves beyond the elastic dome-shaped element 28 and reaches the end of the second part 24 of the opening 22.

In this position, the head 15 in fact cannot disengage by itself due to the elastic retention ensured by the dome-shaped element 28; at the same time, the press-stud 10 ensures excellent resistance, especially in case of tractions which would tend to move apart the two parts 13 and 31 of the item of clothing.

In this regard, it is noted that even simple lifting of the first part 13 from the second part 31 is not possible.

In this manner, any traction applied to the press-stud 10 which does not allow the head 15 to move from the second part 24 to the first part 23 of the opening 22 does not allow the press-stud 10 to open.

In an equivalent manner, a mere pull force along the direction of insertion of the head 15 in the opening 22 is not sufficient on its own; it has to be preceded by a sliding component in order to allow the press-stud 10 to open.

Nonetheless, opening the press-stud 10 is a very simple operation and requires no particular strength.

It is in fact sufficient to move the head 15, making it slide inside the seat 30 until it moves beyond the elastic dome-shaped element 28, so as to move it at the first part 23 of the opening 22, through which it can exit, assisted by the chute 25.

It should be noted that the press-stud 10 can be applied in a fully automatic manner, so long as correct orientation is maintained. It is thus possible to use per se known devices, for example of the type disclosed in U.S. Ser. No. 09/155,286, which are provided with a reference notch or a probe which is capable of detecting the position of the second part 24 of the opening 22, which must be orientated in the direction of the traction applied to the male component after its mating.

Figure 4:
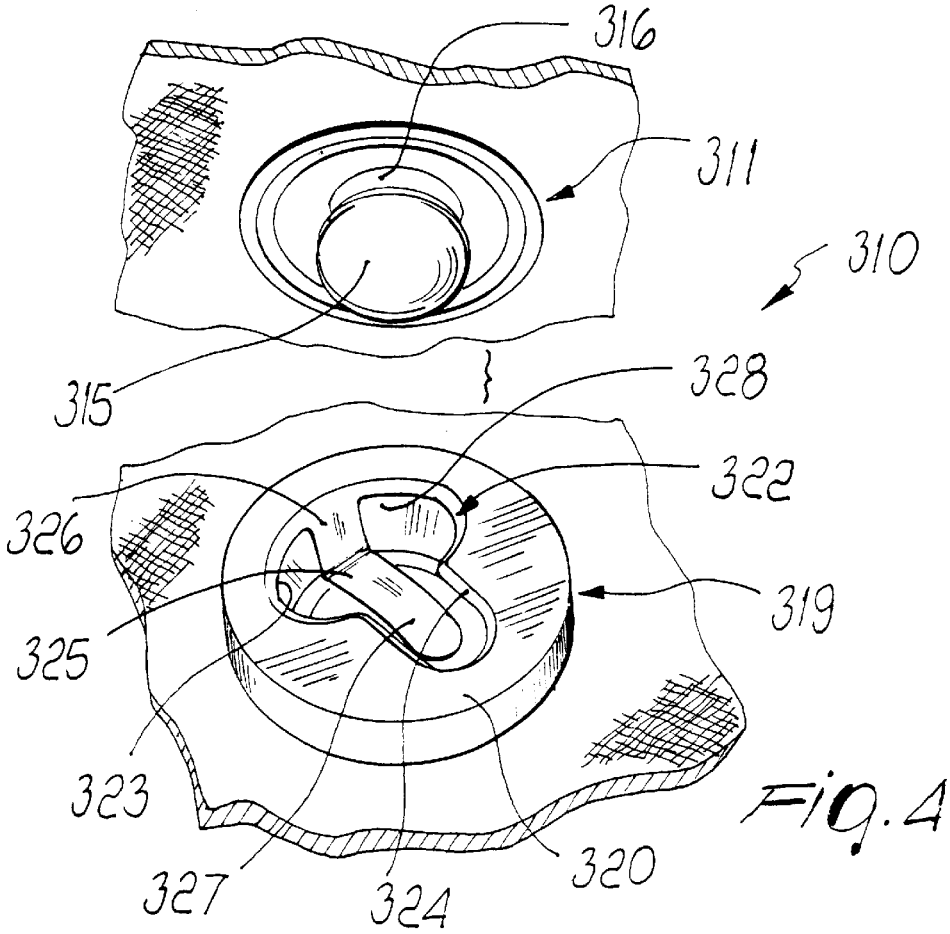
FIG. 4 is a perspective view of a second embodiment of the press-stud in the open position.
Figure 5:
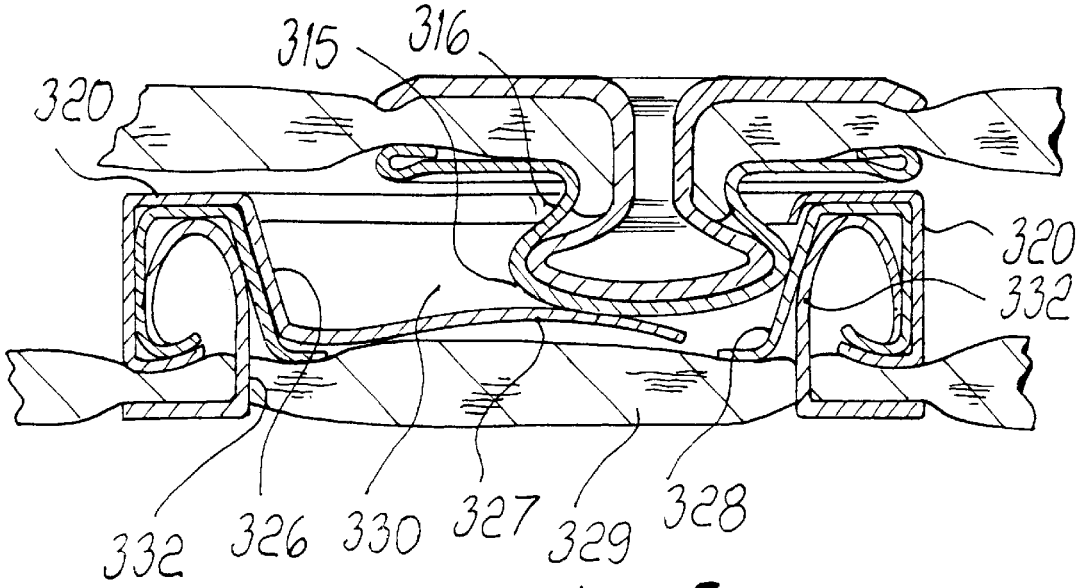
FIG. 5 is a sectional view, taken along a transverse plane, of the press-stud of FIG. 4.

With particular reference to FIGS. 4 and 5, a second embodiment of a press-stud with lateral locking is now designated by the reference numeral 310 and comprises a male component 311, which is fully identical to the preceding one 11, and a female component, which in this case is designated by the reference numeral 319.

Said female component comprises a disk-like dome 320 on which there is an opening 322, formed by blanking, which is fully identical to the opening previously designated by the reference numeral 22 and also has a first wider part 323, which is larger than the head 315 of the male component 311, and a second part 324, which is arranged laterally thereto and has dimensions which are intermediate between those of the head 315 and of the stem 316.

The material removed by blanking in order to obtain the opening 322 is used to produce an elastic tab 325 which protrudes monolithically from a central portion of the rim of the first part 323 of said opening 322.

Said tab 325 has a first inclined and substantially flat portion 326 and a second portion 327 which is conveniently curved and elastic and will be described in greater detail hereinafter.

Said disk-like dome 320 is associated, in this case as in the preceding version, with an annular base 328.

Once the fixing of the female component 319 to a second part 329 of an item of clothing has been completed, by using a claw 332 as in the preceding case, the mutual assembly of the dome 320 and of the base 328 forms an internal seat 330 which can be accessed by the head 315 from the first part 323 of the opening 322.

In particular, the presence of the tab 325, in which the first portion 326 is inclined and substantially adjacent to the rim of the annular base 328 and the second portion 327 is curved and arranged at the bottom of the internal seat 330, limits the volume of said internal seat 330, as will become apparent hereinafter.

In this constructive configuration also, said first portion 326 of the tab 325 constitutes a guide for facilitating access and disengagement of the head 315 through the first part 323 of the opening 322, with respect to the internal seat 330.

When closing the press-stud 310, it is sufficient to move the head 315 of the male component 311 closer until it lies at the first part 323 of the opening 322 and, by following the guide of the first portion 326 of the tab 325, insert it in the internal seat 330.

At this point it is sufficient to guide the head 315 in a translatory motion so that it moves beyond the second curved and elastic portion 327 of the tab 325 and reaches the end of the second part 324 of the opening 322.

In this solution, the head 315 is retained thereat by the second elastic and curved portion 327.

In this manner, any pull force applied to the press-stud 310 which does not allow the head 315 to move from the second part 324 to the first part 323 of the opening 322, after folding the second portion 327 of the tab 325, does not allow the press-stud 310 to open.

In this second embodiment also, the press-stud 310 can be applied in an automatically orientated manner by using suitable devices known per se.

With particular reference to FIGS. 6, 7, 8 and 9, a third embodiment of a press-stud with lateral locking is designated by the reference numeral 110 and comprises a male component 111, which is fully equivalent to the male components described earlier and designated by the reference numerals 11 and 311 and is associated, in this exemplifying case also, with a first part 113 of an item of clothing.

Said male component 111 has a mushroom-shaped element 114 with a rounded head 115 which is larger than the stem 116.

Said press-stud 110 comprises a female component, which is designated by the reference numeral 119 in this case and comprises a dome 120 on which there is a circular opening, and a disk-like element 121 made of a plastic material which has elasticity characteristics.

In particular, on said disk-like element 121 there are three flexible sectors 122 which are arranged at 1200 to each other and form a Y-shaped opening 123 between them.

In said opening 123 there is a central access whose dimensions are delimited by each rounded end 124 of the sectors 122 and is wider than each one of the three end portions 125 arranged at 120° to each other and formed between each pair of sectors 122.

In particular, the dimensions of the head 115 of the male component 111 are conveniently larger than the central access of the opening 123, so that said head can enter it by slightly flexing the three elastic ends 124 of the sectors 122.

Figure 9:
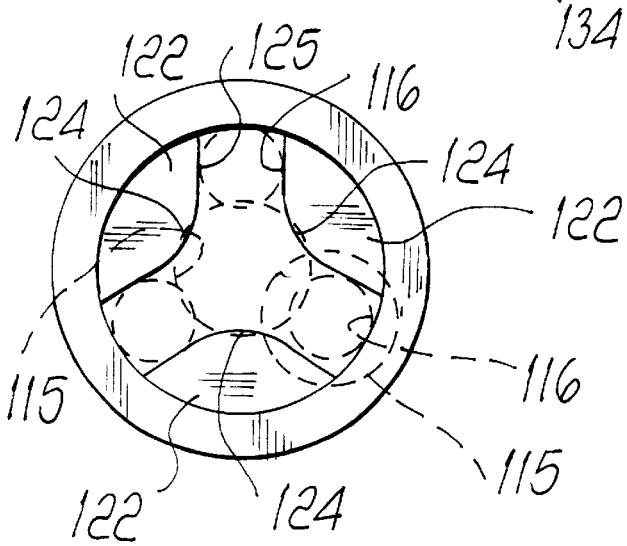
FIG. 9 is a top view of a component of the press-stud of FIGS. 6, 7 and 8.

Correspondingly, the width of each one of the end portions 125 of the opening 123 substantially corresponds to the diameter of the stem 116, as shown by FIG. 9.

Said dome 120 is associated, in an upward region, with a base 126 and said disk-like element 121 is interposed between them.

Said base 126 has a perimetric rim 128 and an annular bottom in which a central rounded raised portion 127 is inserted; said raised portion is made of plastic material which ensures elasticity characteristics.

In this constructive configuration also, said base 126, which keeps the disk-like element 121 fixed against the internal part of the dome 120, arranges itself inside the rim of said dome 120, so that by folding back its rim fixing occurs against the rim 128 of said base 126.

The assembly of the base 126 and of the disk-like element 121 with the dome 120 forms, as a whole, an internal seat 130 in which the head 115 can engage by passing through the central access of the opening 123.

Figure 8:
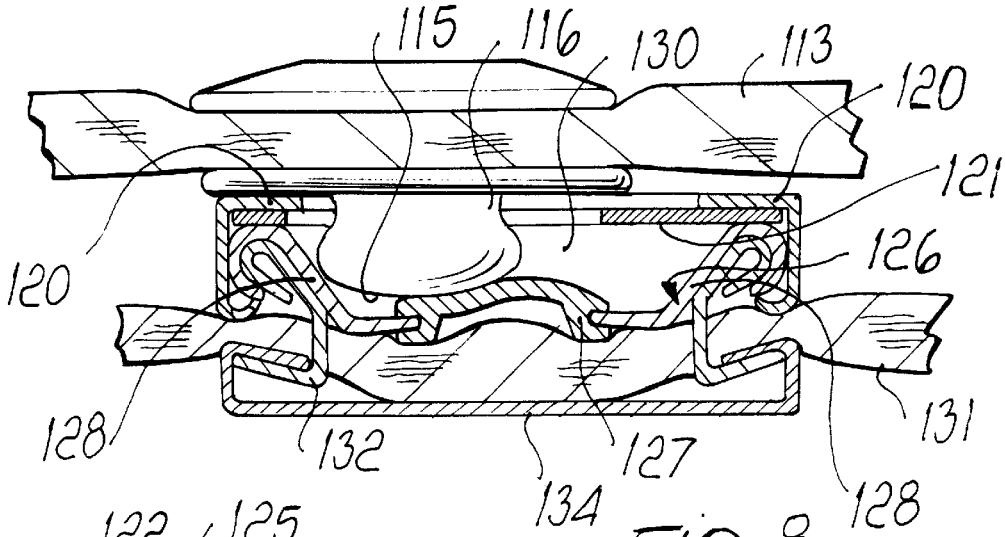
FIG. 8 is a sectional view, taken along a transverse plane, of the press-stud of FIG. 6 in the closed position.

In this configuration also, said female component 119 is associated with a second part 131 of the same item of clothing by using a per se known claw 132, and a decorative cap-like covering 134 (as shown in FIG. 8).

In order to join the first part 113 of the item of clothing to the second one 131 it is sufficient to move the head 115 of the male component 111 toward the central part of the female component 119, so as to place it at the central access of the opening 123.

Once this has been done, said head 115 is inserted in the seat 130 after slightly flexing the ends 124 of the sectors 122.

At this point it is sufficient to guide the stem 116 so as to perform a translatory motion along one of the three end portions 125 of the opening 123. In doing this, the head 115 moves beyond the central raised portion 127 inserted at the bottom of the base 126, so that once it has reached the extremity of the end portion 125 it cannot disengage by itself due to the elastic retention ensured by said raised portion 127 constituted by deformable plastic material.

In this case, the presence of the three end portions 125 arranged substantially at 120° to each other, along each of which the stem 116 can move equally, allows the user to choose the direction in which to slide the stem 116 according to the direction of lateral traction on the press-stud 110.

In summary, this constructive configuration allows to solve any problem related to a "random" arrangement of the male component 111 with respect to the female component 119.

Figure 10:
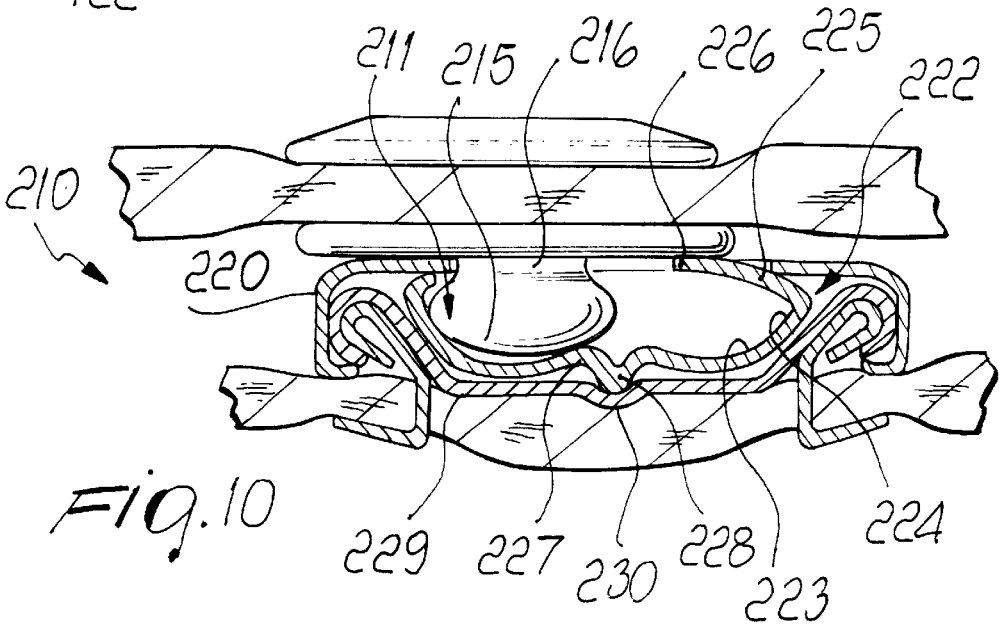
FIG. 10 is a sectional view, taken along a transverse plane, of a press-stud with lateral locking in a fourth constructive embodiment, in the closed position.
Figure 11:
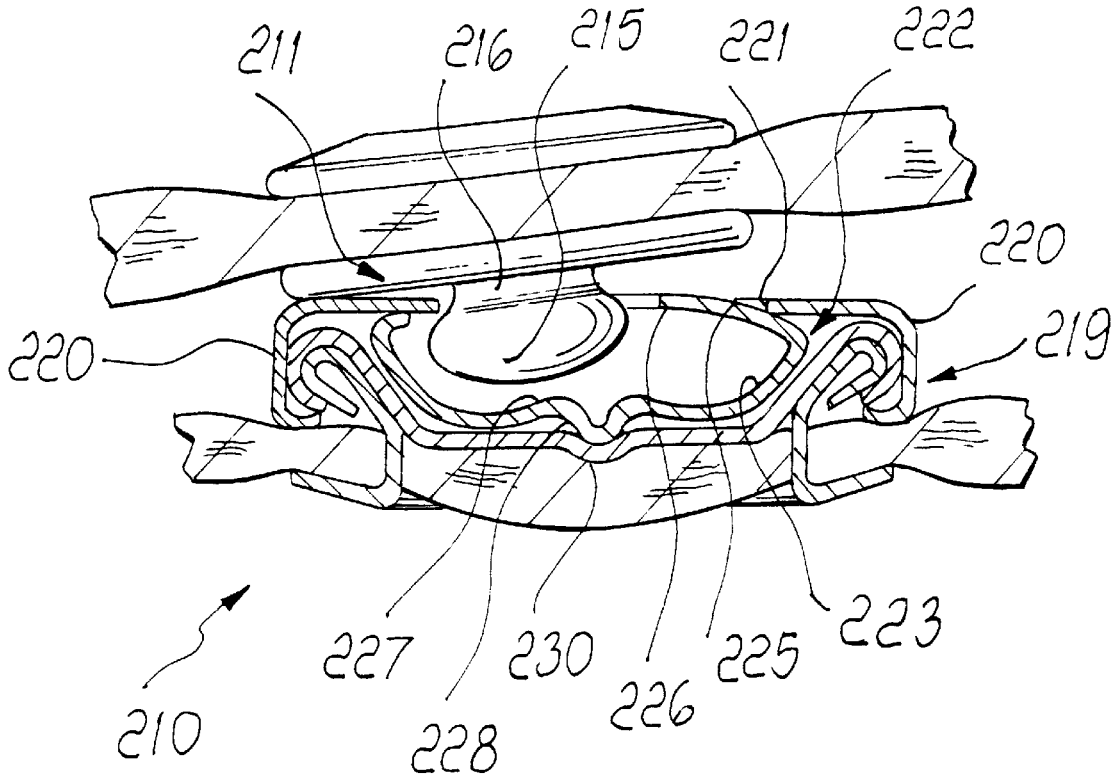
FIG. 11 is a sectional view, taken along a transverse plane, of the press-stud of FIG. 10 during opening.

With particular reference to FIGS. 10 and 11, a fourth embodiment of the press-stud with lateral locking is now designated by the reference numeral 210 and comprises, like the preceding versions, a male component 211 which is fully equivalent to the preceding ones 11, 311 and 111 and engages a female component 219.

Said female component comprises a dome 220 on which there is a circular opening 221 and which contains an internally hollow body 222 made of a plastic material having elasticity characteristics.

In particular, said body 222 is shaped so as to have a substantially circular bottom 223 from which a perimetric rim 224 protrudes.

The upper part of the body 222 is substantially equivalent to the preceding disk-like element 121, since it, too, is provided with three flat sectors 225 which are arranged at 120° to each other.

In this constructive configuration also, said three sectors 225, which are flexible, form a Y-shaped opening between them.

Said Y-shaped opening clearly has a central access whose dimensions are limited by each end 226 of the sectors 225; said central access is wider than the dimensions of each one of the three end portions, which are arranged at 120° to each other and are formed between each pair of sectors 225.

Actually, said three sectors 225 are not perfectly flat; they are inclined so that the central access of the Y-shaped opening is at a higher level than each one of the end portions of said opening.

In particular, said bottom 223 of the body 222 is shaped so as to have a central raised portion 227 which partially limits the volume available inside said body 222 and from which a pin 228 is obtained which protrudes outward.

In this constructive configuration also, the dimensions of the head 215 of the male component 211 are conveniently larger than those of the central access of the Y-shaped opening formed by the three sectors 225, so that the head 215 can enter the body 222, slightly flexing the three elastic ends 226 of the sectors 225.

Correspondingly, the width of each one of the end portions of the Y-shaped opening substantially corresponds to the diameter of the stem 216.

Said body 222 is arranged in the internal space formed by the mating of the dome 220 and a disk-like base 229.

In particular, said disk-like base has, on its bottom, a central seat 230 on which the pin 228 rests.

In this case also, said base 229 is arranged below the body 222 so that its rim is coupled to the internal part of the corresponding rim of the dome 220, so that all the parts are assembled by folding back its end.

It is essential to note that in the internal space formed between the dome 220 and the base 229 in which the body 222 is arranged, the bottom 223 and the rim 224 thereof substantially do not touch the disk-like base 229 at any point, except for the pin 228 arranged in the seat 230.

In this manner it is possible to insert the head 215 through the central access of the Y-shaped opening in order to enter the body 222 and, after this has been done, move beyond the raised portion 227, making the stem 216 slide along one of the end portions of said Y-shaped opening.

In this constructive configuration, however, the body 222 can rotate freely with respect to the pin 228 and therefore the end portions of the Y-shaped opening can be orientated conveniently.

The most important effect of this freedom of orientation of the end portions is above all the fact that it simplifies the automatic application of the female component 219, which need no longer be orientated but can be entirely random.

It is very important to note that in disengaging the male component 211 from the female component 219 it is sufficient, in this case, to apply simple traction, since the combined sliding and pulling motion occurs automatically.

Thanks to the shape of the portion that connects the head 215 and the stem 216, and with the aid of the matching inclination of the sectors 225, the head 215 which is affected by simple traction tends to rotate, as shown in FIG. 11, so that it is affected by a component of the traction which "guides" in the end portion in which it is located, in the position reached with the preceding closure operation, directly toward the central access.

In practice it has been found that the present invention has more than satisfactorily achieved the intended aim and all the objects.

A remarkable feature that must be noted is achieved, by means of the present invention, in that a press-stud with lateral locking has been devised which requires, both during closure and during opening, a considerably smaller force than conventional press-studs without however allowing any possibility of accidental opening when the traction stresses to which it is normally subjected occur.

Another remarkable advantage has been achieved in view of the fact that the described press-stud with lateral locking does not force the user, in the case of application to items of clothing, to resort to particular precautions in order to protect the part of the user's body that lies below each press-stud so as to avoid hurting himself.

Still another remarkable advantage is ensured in that a press-stud has been provided which, in the fourth described embodiment, excellently solves any orientation problems, allowing the user maximum freedom.

Another advantage has been obtained in that a press-stud has been provided which can be applied in a fully automatic manner.

The present invention is susceptible of numerous modifications and variations, all of which are within the scope of the same inventive concept.

All the details may be replaced with other technically equivalent elements.

The materials used, so long as they are compatible with the contingent use, as well as the dimensions, may be any according to requirements.

The disclosures in Italian Patent Application No. PD99A000027 from which this application claims priority are incorporated herein by reference.

What is claimed is:

1. A press-stud with lateral locking comprising:

a male component having:

a mushroom-shaped element including a stem and a head protruding at a free end of said stem, with said head having cross-sectional dimensions which are larger than cross-sectional dimensions of said stem; and a female component having:

a seat for accommodating, upon insertion, said head of the mushroom-shaped element;

an opening including a first larger part and a second smaller part, said second smaller part having opening dimensions intermediate between the cross-sectional dimensions of said stem and those of said head;

elastic contrast elements for elastically urging said head during insertion and extraction thereof occurring upon movement of the head, over said elements, from said first part to said second part of said opening and viceversa; and a dome-shaped element which engages a hole formed at the bottom of said seat, said dome-shaped element being made of plastics.

2. The press-stud of claim 1, wherein said elastic contrast elements are constituted by a raised portion which rises from a bottom part of said seat, said raised portion being made of a material which ensures elasticity characteristics.

3. The press-stud of claim 1, wherein said elastic contrast elements are constituted by a curved elastic tab which is arranged at a bottom part of said seat.

4. The press-stud of claim 3, wherein said tab protrudes from the rim of said first part of said opening that is larger than said head, said tab having a first inclined flat portion and second curved elastic portion, said second elastic portion being arranged at the bottom of said seat and extending at said second part of the opening whose dimensions are intermediate between the dimensions of said head and said stem of the male component, said first portion acting as a chute in order to facilitate insertion of said head in said seat.

5. The press-stud of claim 1, wherein said opening has a first part, which forms a wider opening profile whose dimensions are larger than the dimensions of said head, and a second elongated part, whose dimensions are intermediate between those of said head and those of said stem.

6. The press-stud of claim 5, wherein said second part of the opening runs substantially laterally with respect to the first part so as to define a direction for traction to be applied to the male component at mating.

7. The press-stud of claim 6, comprising an inclined flat portion that extends from a rim of said first part of the opening, said flat portion acting as a chute in order to facilitate the insertion of said head in the seat.

8. The press-stud of claim 7, comprising two wings protruding from a rim of said second part of the opening, each one of said wings extending from an opposite portion of a region connecting said first part to said second part of the opening, said wings acting as a guide for a sliding motion of the stem along said second part of the opening so as to avoid scraping.

9. The press-stud of claim 1, comprising; a centrally open upper dome; a base; a disk element which is interposed between the centrally open upper dome and the base, said disk element having three flexible sectors, arranged at 120° with respect to each other so as to form a Y-shaped opening in which a central access is formed, said central access being delimited by ends of said sectors, and said Y-shaped opening having three end portions arranged at 120° to each other, the cross-sectional dimensions of said head of the male component being greater than said central access so that said head enters said access by slightly flexing the ends of said sectors, said end portions of the opening having each a width corresponding to a cross-sectional diameter of said stem.

10. The press-stud of claim 9, comprising a shaped body which is interposed between said upper dome and said base and forms, in its upper part, said three flexible sectors arranged at 120° to each other which form said Y-shaped opening, said shaped body having a pin, and a bottom which forms a central raised portion which partially limits volume available inside said body and from which said pin.

* * * * *